US006021711A

United States Patent [19]

van Ottele

[11] Patent Number: 6,021,711

[45] Date of Patent: Feb. 8, 2000

[54] BAND STRAPPING DEVICE

[75] Inventor: Johannes Gerardus Wilhelm van Ottele, Boegbeeld, Netherlands

[73] Assignee: Endra B.V., Netherlands

[21] Appl. No.: 09/108,530

[22] Filed: Jul. 1, 1998

[30] Foreign Application Priority Data

Jul. 2, 1997 [NL] Netherlands ..... 1006455

[51] Int. Cl.[7] ..... B65B 13/32

[52] U.S. Cl. ..... 100/11; 53/228; 53/586; 100/18; 100/29; 100/33 PB

[58] Field of Search ..... 100/7, 11, 17, 100/18, 19 R, 29, 32, 33 R, 33 PB; 53/228, 586, 373.4, 374.6, 374.8

[56] References Cited

U.S. PATENT DOCUMENTS 3,950,203 4/1976 Van der Wal ..... 100/33 PB
4,366,021 12/1982 van der Wal ..... 100/33 PB
4,782,648 11/1988 Van Ottele ..... 53/228

FOREIGN PATENT DOCUMENTS 4401508 5/1995 Germany .
7314312 4/1975 Netherlands .

*Primary Examiner*—Stephen F. Gerrity
*Attorney, Agent, or Firm*—Joan H. Pauly

[57] ABSTRACT

A device for strapping a plurality of packets with a band includes a frame and a lying conveyor belt supported by the frame for moving the packets forward. A pair of band clamping and guiding jaws move toward and away from each other transversely of the belt. A band supply reel is associated with the jaws. A welding device coacts with the jaws for welding band portions together. Each jaw has a clamping surface that runs transversely relative to the forward direction and coacts with a counter-surface of an intermediate body carried by one of the jaws. A portion of the clamping surface and the counter-surface extend obliquely relative to the forward direction. One of the surfaces has tooth-like protrusions.

8 Claims, 4 Drawing Sheets

BAND STRAPPING DEVICE

TECHNICAL FIELD

The invention relates to a device for strapping two or more packets with a band, which device substantially comprises a frame, a lying conveyor belt supported by the frame for moving forward the packets, a pair of band clamping and guiding jaws movable toward and away from each other transversely of the conveyor belt, a supply reel associated with a jaw and guide members for the strapping band in addition to welding means co-acting with the jaws for welding together the band portions supplied by the pair of jaws, wherein each jaw has a clamping surface which runs transversely relative to the direction of movement and which co-acts with a counter-surface of an intermediate body carried by one of the jaws.

BACKGROUND INFORMATION

A device of the type described in the preamble of claim 1 has the advantage that in quite rapid manner loose packets can be combined into a larger packet by means of strapping with a band which is in fact composed of two parts, the one part end of which is connected to the other part end by a heat weld, and wherein the closing end is likewise realized by a heat weld, during which welding operation the band is held firmly round the packet. This latter requires a rather large tensile force in the band, which tensile force must be produced by the clamping force of the closing jaws, which in turn results in relatively great wear on the guide edges thereof. The known welding jaws moreover have the drawback that when they are retracted some play is released into the band, which causes a reduction in the tensioning force in the band and therefore makes holding together of the strapped packet less stable.

BRIEF SUMMARY OF THE INVENTION

The invention has for its object to obviate the above stated drawbacks and provides for this purpose a device which is distinguished in that the clamping and counter-surface extends obliquely relative to the direction of movement, wherein at least one of the surfaces is provided with tooth-like protrusions set obliquely relative to the pulling direction.

Owing to the oblique clamping surfaces proposed by the invention the play which must be applied for welding of the band is considerably reduced, so that after completion of the weld the band will spring back less, whereby the initial tensioning force in the band also maintained round the finished packet.

In addition, arranging of the oblique teeth on one of the surfaces of the clamping jaws will give the advantage that the band is held more firmly and will not slip back, so that the braking members determining the tensioning force of the band in the device can be adjusted more tightly so that a higher tensioning force in the band can be obtained.

Above mentioned and other features of the invention will be further elucidated hereinbelow in the figure description of an embodiment.

DETAILED DESCRIPTION OF THE INVENTION

Figure 1:
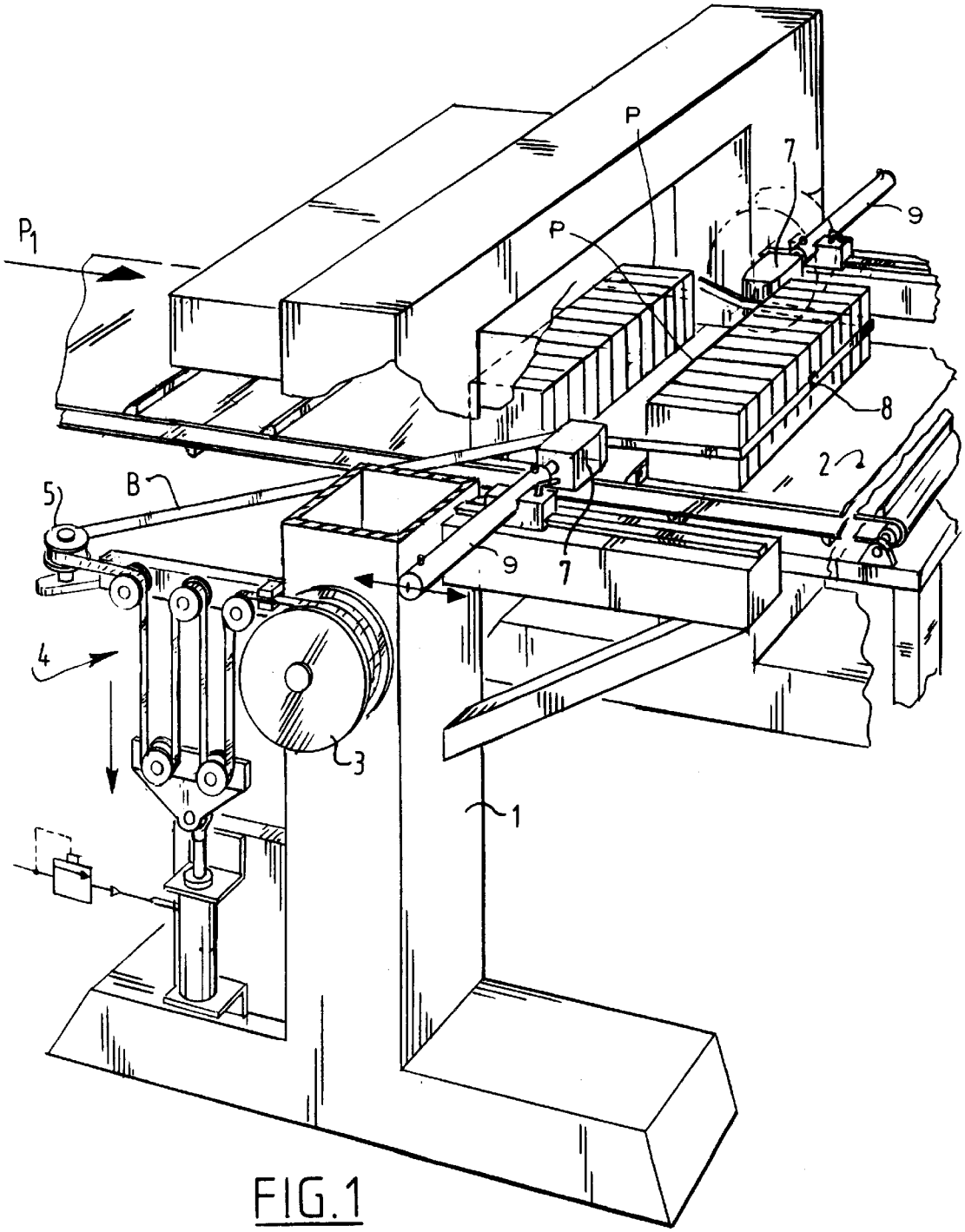
FIG. 1 shows a perspective schematic view of a strapping device according to the invention.

Designated in FIG. 1 with the numeral 1 is a frame of the device which can be constructed in random manner. The frame is portal-like such that a conveyor 2 can be arranged under the portal for transporting packets P in the direction of arrow P1. The packets are combined into a series of packets around which a band B must be strapped. To this end the band can be, unwound from a supply 3 and is guided to welding-clamping jaws 7 via a braking mechanism 4, which is assumed known in the professional field and requires no further explanation, and via reversing pulleys 5. It is stated for the sake of clarity that supply roll 3 with the band guide systems 4, 5 is likewise arranged on the other side of the device. Both ends of the band on the left-hand respectively right-hand side of conveyor 2 are welded to each other at 8, wherein clamping jaws 7 are moved toward each other behind the combined packet P by means of a cylinder 9. The band is herein nestled against the rear side P and held under tension by the braking means 4.

When the band B is held under tension, wear will occur on the guide edges due to the sliding movement along clamping jaws 7.

Figures 2, 3:
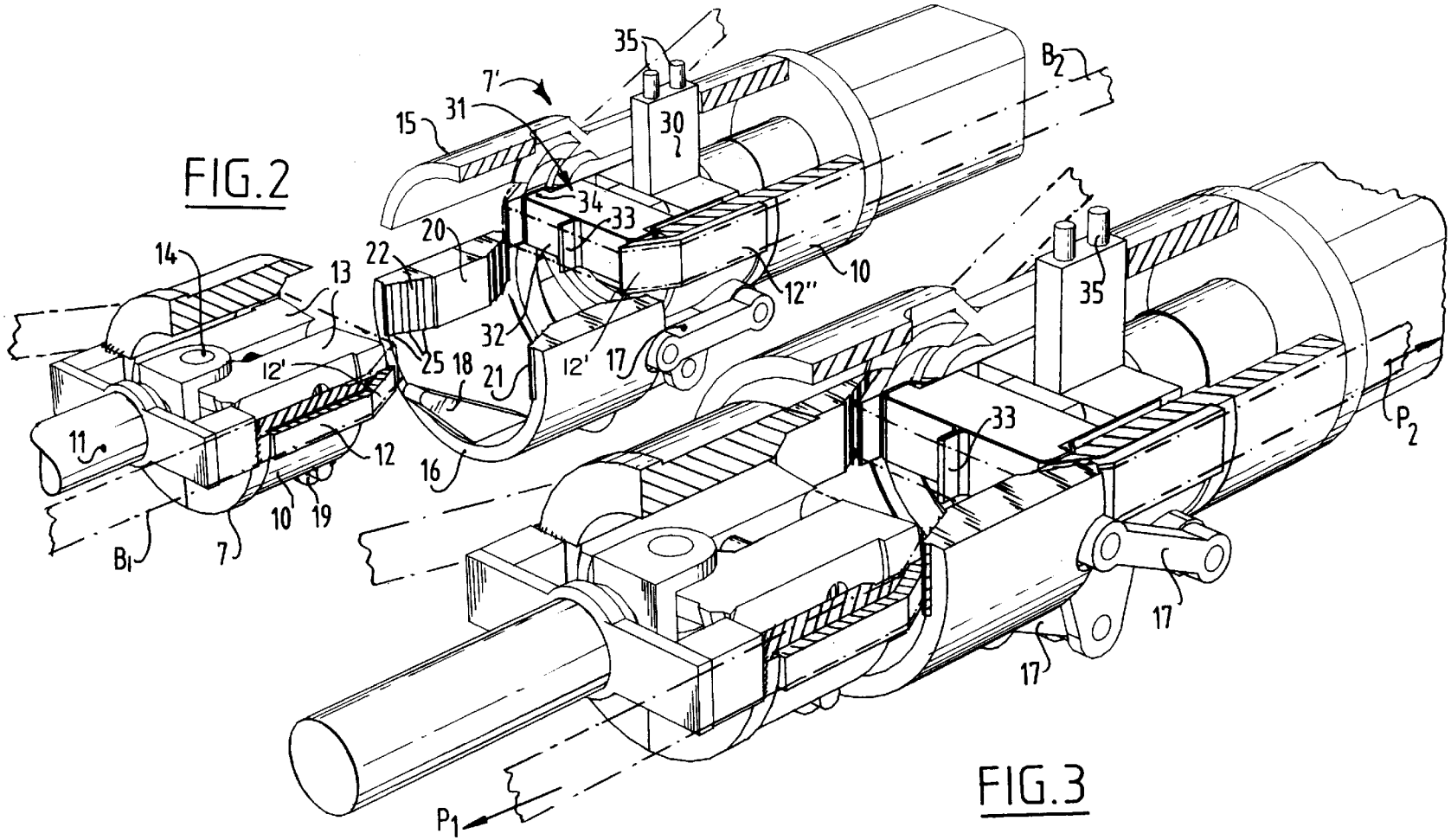
FIG. 2 shows a perspective view with partly broken away parts of the mutually opposing clamping jaws just before closing thereof.
FIGS. 3, 4 and 5 shows perspective views corresponding with FIG. 2 in the different operational positions of the clamping jaws.

As will be apparent from the above, the band B1 on the left in FIG. 2 and B2 on the right in FIG. 2 runs from the supply on the main frame along the side surfaces of the two co-acting welding jaws, which are shown in detail in FIG. 2.

The left-hand welding jaw 7 has a sleeve-like housing 10 which is mounted on the end of piston rod 11. Sleeve-like housing 10 has on the outside guide surfaces 12 for the band B1, wherein guide surface 12 initially extends axially but runs obliquely inward towards the end, see 12'. In sleeve-like part 10 is arranged a pair of pressure shoes 13 which can pivot in the horizontal plane relative to shaft 14. The operation thereof is further elucidated hereinbelow.

The right-hand welding jaw 7' is likewise provided with a sleeve-like housing 10, on the outside of which a guide surface 12" corresponding with 12 is arranged via inserts, over which surface the band B2 is guided.

Over a part of the periphery the sleeve-like housing 10 of welding jaw 7' takes a widened form at 15 toward the side of the co-acting welding jaw 7. The remaining part of the periphery is formed by a sleeve-like part 16 open at the top which is movable up and downward relative to housing part 10 of welding jaw 7' via a pivoting arm 17. On the inner side of this part 16 is arranged a rise cam 18 which co-acts with a cam 19 on the underside of the left-hand welding jaw 7.

Arranged on the inside of part 16 on a level with the height of the guide surfaces 12, 12" is a body 20 respectively 21 which is provided with counter-clamping surfaces 22.

Figure 6:
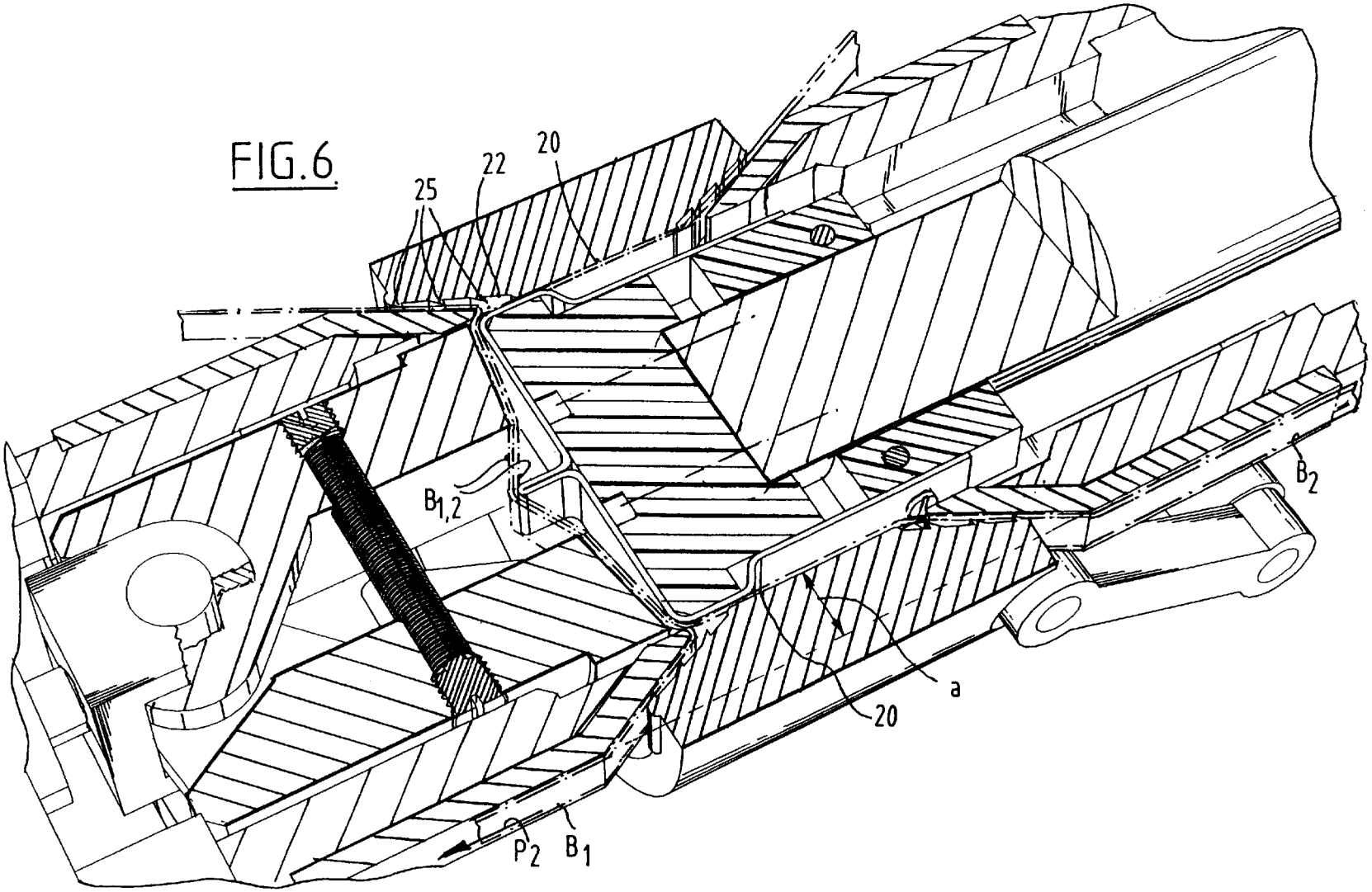
FIG. 6 is a perspective view on enlarged scale of the position as shown in FIG. 5.

FIG. 6 shows in detail that counter-clamping surface 22 is embodied with teeth 25 which protrude inward.

In housing part 10 of right-hand welding jaw 7' is arranged a welding head 30 which consists of a heatable body 31 around which is folded a welding strip 32. This latter has a protruding ridge 33 in the centre line part and extends outward therefrom as far as a hammer-shaped part 34 to form a welding shoe. Welding head 30 can be shifted forward in housing part 10 against clamping shoes 13, this being further elucidated below.

The above described operation of the welding beads is as follows. Starting from the position of FIG. 2 the bands B1 and B2 are each guided individually round a guide surface 12, 12" and the opposite guide surface on the other side of the welding jaw. In this situation the annular part 16 is moved downward relative to the centre line of the mutually opposite cylinder rods 11 of the welding heads.

Due to the further movement of the welding heads toward each other the annular part 16 will initially move upward on pressure roller 19 by means of cam 18, wherein annular part 16 is pressed against the housing part 15 lying above, wherein the horizontal position of bodies 20 is ensured by the parallel guiding formed by arms 17.

The forward movement of the welding heads continues further until the surfaces 12' of guide strips 12 press against the counter-surfaces 22. This situation is shown in FIG. 3. The bands are firmly clamped between the co-acting surfaces 12' and 22, wherein the inward protruding teeth 25 grip the bands firmly to prevent slippage resulting from the tensile force on the band in the direction of arrow P2, see also FIG. 6.

By moving welding head 31 further to the left toward the pair of clamping bodies 13, the band portions will initially be situated at a mutual distance and reach no further than the transition between surface 22 and 20 of the counter-body in housing part 16.

By heating the welding head 31 the ridge 33 will be heated such that the band part situated in front of it will be melted through.

As welding head 31 is moved further toward clamping bodies 13, the band will extend over the surface 20. The heated ridge 33 then reaches the opposite band portion between the surfaces 12' of the left-hand clamping head and will likewise melt this through.

Figures 4, 5:
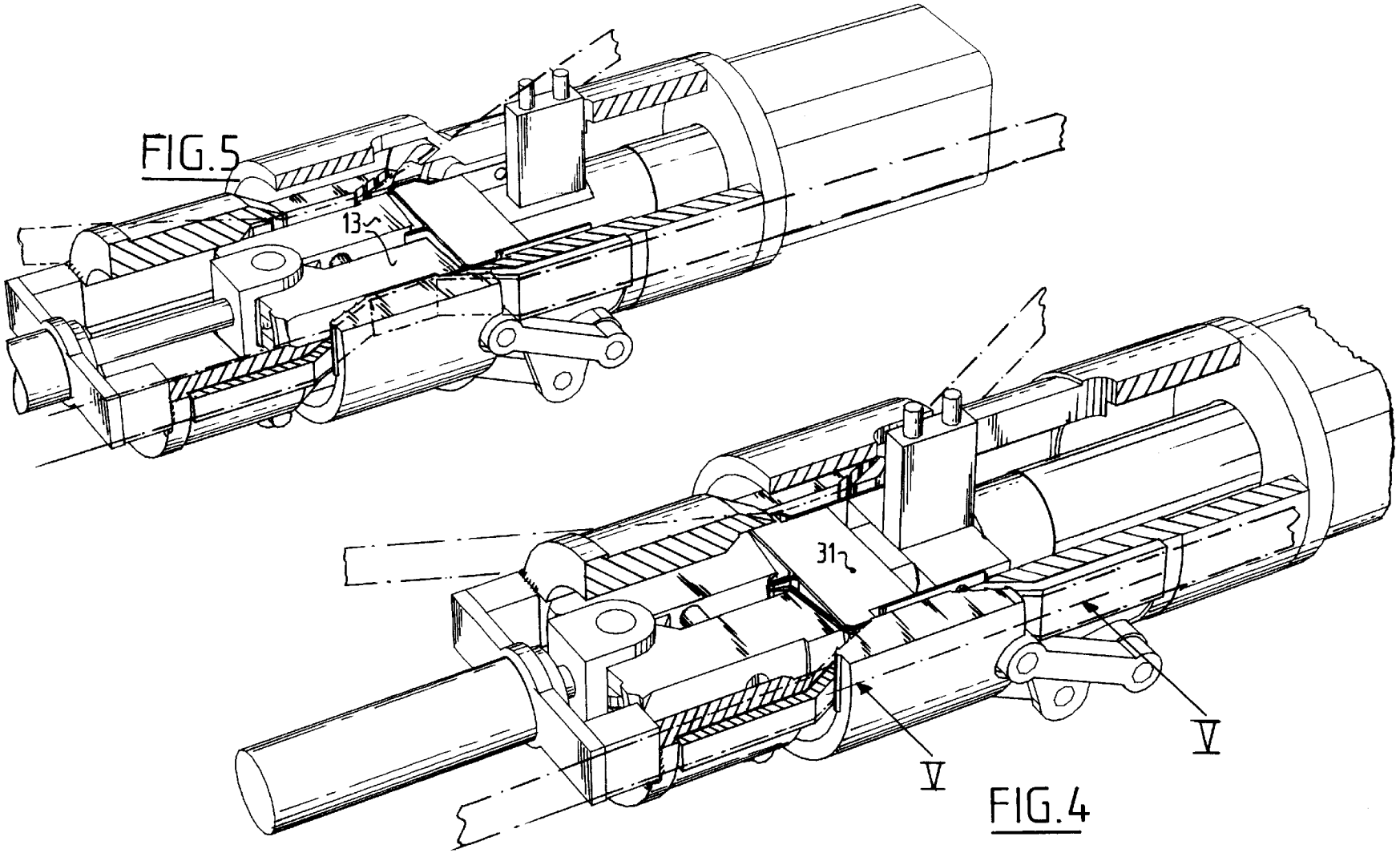

When clamping bodies 13 are moved to the right this band portion is nestled over the band portion of the right-hand clamp already lying on surface 20, whereafter the already heated band portions are welded together by the hammer-like ends 34 of the welding shoe while the portions are being pressed by the outward spread clamping bodies 13, see FIG. 5. In this manner the band portions are melted together on the left-hand and right-hand side of the clamping jaws, wherein it is assumed that the band facing toward the reader is situated on the rear of the packet P in FIG. 1, and therefore forms the band loop, while the band facing away from the reader in FIG. 4 is the new strapping band for the following packet on the conveyor. When the welding is completed and the clamping jaws retracted, the band is released and will straighten slightly as a result of the displacement of the band portion on surface 20 into the line of the stretched band. This displacement is indicated with "a" in FIG. 6 but, owing to the inclining surfaces 12' and counter-surface 22 this causes hardly any elongation of the band loop round the packet and will hardly reduce the tension therein at all.

Wear of the welding or clamping heads 7 resulting from the higher allowed tension in the band is avoided due to the guide bodies 12, 12" embodied as inserts.

The invention is not limited to the above described embodiment.

I claim:

1. Device for strapping at least two packets with a band, which device includes a frame, a lying conveyor belt supported by the frame for moving the packets in a forward direction, a pair of band clamping and guiding jaws movable toward and away from each other transversely of the forward direction, a band supply reel, and welding means co-acting with the jaws for welding together band portions supplied by the jaws, each jaw having a clamping surface that runs transversely of the forward direction and that co-acts with a counter-surface of an intermediate body carried by one of the jaws, wherein the improvement comprises the counter-surface and at least a portion of the clamping surface extending obliquely relative to the forward direction, at least one of said portion of the clamping surface and the counter-surface being provided with tooth-like protrusions set obliquely relative to a direction in which the associated jaw tensions the band.

2. Device as claimed in claim 1, characterized in that the clamping surface on each of the jaws is formed by the outer surface of an insert.

3. Device as claimed in claim 2, characterized in that the tooth-like protrusions are arranged on the counter-surface.

4. Device as claimed in claim 2, characterized in that the clamping surface has a guiding edge that extends beyond the associated jaw.

5. Device as claimed in claim 4, characterized in that the tooth-like protrusions are arranged on the counter-surface.

6. Device as claimed in claim 1, characterized in that the clamping surface has a guiding edge that extends beyond the associated jaw.

7. Device as claimed in claim 6, characterized in that the tooth-like protrusions are arranged on the counter-surface.

8. Device as claimed in claim 1, characterized in that the tooth-like protrusions are arranged on the counter-surface.

* * * * *